US005282326A

United States Patent [19]

Schroer, Jr. et al.

[11] Patent Number: 5,282,326

[45] Date of Patent: Feb. 1, 1994

[54] REMOVEABLE INNERSOLE FOR FOOTWEAR

[75] Inventors: Charles F. Schroer, Jr., Bartlett; Ronald L. Bracken, Memphis, both of Tenn.

[73] Assignee: Schering-Plough HealthCare Products, Inc., Memphis, Tenn.

[21] Appl. No.: 903,414

[22] Filed: Jun. 24, 1992

Related U.S. Application Data

[63] Continuation-in-part of Ser. No. 727,205, Jul. 9, 1991, abandoned.

[51] Int. Cl.[5] ..... A43B 13/40; A43B 13/38

[52] U.S. Cl. ..... 36/44; 36/145; 36/181

[58] Field of Search ..... 36/91, 44, 145, 155, 36/164, 165, 166, 169, 178, 181

[56] References Cited

U.S. PATENT DOCUMENTS

| | | | |
|---|---|---|---|
| D. 259,675 | 6/1981 | Gorden et al. . | |
| D. 263,644 | 4/1982 | Vinnecour et al. . | |
| D. 302,487 | 8/1989 | Fox . | |
| D. 336,718 | 6/1993 | Schroer, Jr. | D2/318 |
| 738,228 | 9/1903 | Nathan | 36/181 |
| 1,103,464 | 7/1914 | Arrowsmith | 36/181 |
| 1,236,924 | 8/1917 | Golden . | |
| 1,466,386 | 8/1923 | Smith . | |
| 1,550,715 | 8/1925 | Stout . | |
| 1,930,889 | 10/1933 | Waksmundzka | 36/181 |
| 1,999,507 | 4/1935 | Lyss et al. | 36/155 |
| 2,034,463 | 3/1936 | Dvlinsky . | |
| 2,063,625 | 12/1936 | Rigandi | 36/181 |
| 2,613,455 | 10/1952 | Amico | 36/155 |
| 2,658,288 | 11/1953 | Scholl | 36/44 |
| 2,803,895 | 8/1957 | Frieder et al. . | |
| 2,961,781 | 11/1960 | Scholl . | |
| 2,965,984 | 12/1960 | Scholl . | |
| 3,449,844 | 6/1969 | Spence . | |
| 3,470,880 | 10/1969 | Pagliano . | |
| 3,530,489 | 9/1970 | Appleton | 36/44 |
| 3,766,669 | 10/1973 | Pearsall . | |
| 3,929,140 | 12/1975 | Wesberg . | |
| 4,020,570 | 5/1977 | Shames | 36/43 |
| 4,054,706 | 10/1977 | Shapiro | 36/44 |
| 4,055,699 | 10/1977 | Hsiung | 36/44 |

(List continued on next page.)

FOREIGN PATENT DOCUMENTS 1165775 10/1958 France .

OTHER PUBLICATIONS

Pp. 28 and 29 titled "Arch Supports" for the Dr. Scholl's line of footproducts.

Photocopy of label from Esquire "Flexible leather Arch Supports with Comfort Cushions", Modern Ortho Corp., New York, 10012.

Photocopy of packaging for "Spenco ¾ length Arch Supports", together with a pictured insole attached thereto, which recites U.S. Pat. No. 3,449,844.

*Primary Examiner*—Steven N. Meyers

*Attorney, Agent, or Firm*—Joseph T. Majka; John J. Maitner; Eric S. Dicker

[57] ABSTRACT

A removable, three quarters length, innersole for an article of footwear, adapted to provide cushioning and/or support to a foot. Said innersole comprises a forward toe portion having a radius edge, a rear heel portion having a radius edge and an intermediate arch cushion portion between said toe and heel portions. The forward toe portion, the rear heel portion and said intermediate arch cushion portion are one-piece. The innersole being resilient. The innersole including a first flat bottom surface, a second upper surface having an intermediate arch portion whose contour is generally convex-shaped and a third concave-shaped surface extending from said bottom surface to said upper surface to define with said upper surface an arched projection extending upwardly from said bottom surface and outwardly at a distance about equal to or greater than the tangent of said toe radius edge and said heel radius edge. The arched projection defining a space beneath said third surface. The innersole permits said projection to resiliently deform into the space defined by said projection upon application of a load to said innersole to provide cushioning and/or support to an arch.

12 Claims, 4 Drawing Sheets

U.S. PATENT DOCUMENTS 4,128,951 12/1978 Tansill .
4,338,734 7/1982 Schwartz .
4,513,518 4/1985 Jalbert et al. .
4,520,581 6/1985 Irwin et al. .
4,580,356 4/1986 David .
4,586,273 5/1986 Chapnick .
4,597,196 7/1986 Brown .
4,619,056 10/1986 Lin et al. .
4,627,177 12/1986 Meyers .
4,627,178 12/1986 Sullivan et al. .
4,674,204 6/1987 Sullivan et al. .
4,686,994 8/1987 Harr et al. .
4,688,338 8/1987 Brown .
4,694,590 9/1987 Greenawalt .
4,739,765 4/1988 Sydor et al. .
4,742,625 5/1988 Sydor et al. .
4,756,096 7/1988 Meyer .
4,793,078 12/1988 Andrews .
4,823,420 4/1989 Bartneck .

REMOVEABLE INNERSOLE FOR FOOTWEAR

This is a continuation-in-part of application of Ser. No. 727,205 filed Jul. 9, 1991, now abandoned.

FIELD OF THE INVENTION

The present invention relates to a novel innersole for footwear useful for supporting and cushioning feet. This application is filed concurrently with co-pending U.S. patent application Ser. No. 727,206 entitled, "Method for Preparing Molded Innersoles Having a Non-Slip Surface", filed Jul. 9, 1991 and with our design U.S. patent application Ser. No. 737,535 entitled, "INNERSOLE", filed on Jul. 9, 1991, both of which are incorporated herein by reference.

BACKGROUND OF THE INVENTION

Innersoles, especially those containing arch supports, have been used historically to relieve foot and leg discomfort due to flat or low arches, high arches, overpronation, over-supination, valgus, varus, and a variety of other conditions. The function of the longitudinal arch is to provide a flexible, shock absorption mechanism for the body while standing, walking, running, etc. When this mechanism is not functioning properly, several disorders can develop.

Pronation is the tendency for the longitundinal arch to depress and roll inward. This action is usually accompanied with a rolling inward and downward of the medial side of the foot and ankle, an outward rotation of the heel and an outswing of the forefoot. Some people with flat or low arches experience excessive pronation, also known as overpronation. Discomfort in the arch of the foot is common in persons with over pronation because excessive repetitive stress is placed on joints and ligaments in the midpart and hind-part of the foot. Leg fatigue and discomfort is also common because there is an overuse of leg muscles which resist the repetitive depression of the arch. In some instances, arch supports are prescribed after bunion surgery because overpronation can lead to a recurrence of bunion deformities. These devices typically help by realigning the foot to achieve a neutral positioning of the bone structures. Some of these devices employ subtle or passive methods of cushioning to achieve a comforting effect while others use rigid or force-fit methods of realigning the foot. Many innersoles require fitting to a shoe size that is larger than the user would typically wear. This indicates that most innersoles are too bulky to provide a comfortable, non-restrictive fit in properly sized shoes when both the foot and the arch support occupy the same space. Others are trimmed to fit the shoe. Other devices are constructed with laminated foams and then thermoformed or compression molded to achieve a contoured effect. Laminated articles have the potential for delaminating over time, with use. These devices typically blend a heel cup with the arch cushion to stabilize the rear foot in addition to supporting the longitudinal arch. Full length shoe inserts, which utilize polyurethane foam molding technology, are shaped similarly to the formed foam devices in that a contoured heel cup and blended arch cushion are predominant structures in the device. Most of these devices employ some type of topcover for visual and performance reasons. They also tend to crowd the foot due to the toe area having a full thickness of cushioning material as well as an over cushioning of the heel which tends to raise the ankle, thereby losing the support of the shoe itself.

By way of example, U.S Pat. No. 4,823,420 discloses a contour molded insole for footwear including an insole blank shaped to include an upwardly concave surface portion which, under pressure, is caused to invert to form a convex surface. U.S. Pat. No. 4,756,096 discloses a custom molded insole for supporting the foot in a ski boot made of a thin, formed blank of semi-rigid, bendable resilient material molded to the contour of the plantar surface/sole of a human foot, wherein the blank extends along the full length and width of the foot. U.S. Pat. No. 4,627,177 discloses a footwear insole member made of a first portion in which the area of the upper surface approximately underlies the area of the longitudinal arch and a second portion the area of the upper surface of which underlies at least about 10% of the medial area of the heel and from 0 to about 50% of the lateral area of the heel. U.S. Pat. No. 4,619,056 discloses an insole with integrally molded ridges to provided enhanced support for the foot in the region of the arch. U.S. Pat. Nos. 4,627,178 and 4,694,589 disclose an elastomeric shoe innersole made of a molded, elastomeric polyurethane foam material of low compression set, the heel and arch sections directly bonded in the molding process to a full-sole material composed either of foam or a solid, flexible sheet material. U.S. Pat. No. 4,674,204 discloses a shock absorbing innersole similar to that of U.S. Pat. No. 4,694,589, and also containing a solid, shock-absorbing heel insert. U.S. Pat. No. 4,586,273 discloses a shoe insert for reducing impact to the foot made of a base layer of a relatively resilient material, a foam layer disposed over the base layer and the means for integrally forming the base layer, foam layer and fabric into a sheet tri-laminate. U.S. Pat. No. 4,580,356 discloses a removable insole for shoes, the original profile of which is flat or curved, and which due to different grooves, gradually becomes permanently deformed on contact with the foot and finally adopts the profile thereof. U.S. Pat. No. 4,513,518 discloses an inner sole with a cushioning layer of polyurethane foam, with compression set less than 10%, laminated to a thinner layer of thermoformable polyethylene foam, which serves primarily as a vehicle for shaping the polyurethane. U.S. Pat. No. 4,338,734 discloses a universal orthotic which includes a monolithic shell, which may include a heel post, a navicular flange and a metatarsal raise, all formed monolithically to facilitate its manufacture. U.S. Pat. No. 2,034,563 discloses a longitudinal arch supporting shoe element composed of an inner sole split from its heel end into its ball portion, the split portion includes a relatively thick bottom layer and a thinner top layer. U.S. Pat. No. 2,965,984 discloses an arch supporting insole having a top sheet of plastic film, a thicker sheet of plastic foam beneath the top sheet, a partial bottom sheet of plastic film beneath the foam sheet, a heat seal seam joining all of the sheets and defining the bounding edge of the insole. U.S. Pat. No. 2,803,895 discloses a protective innersole made of a plurality of stacked laminates including a top laminate, a bottom laminate, each of said laminates having a pair of ends and an area substantially coextensive with the sole. U.S. Pat. No. 1,466,386 discloses a foot support adapted to be worn inside a boot or shoe, an insole, an uncovered semi-circular pad of sponge rubber cemented to the underface of the insole at the longitudinal arch, and an attaching strip secured to the pad and insole for holding the pad more firmly in position. Most of these innersoles are too bulky to fit within a normal shoe, causing the foot to be overly restricted within the shoe.

There is a need to provide a thin, removable, non-slip innersole that provides arch support through material resilience and yet has structural resilience to allow for a comfortable fit for both the feet and the innersole in a shoe. There is also a need to provide a three dimensionally contoured, wholly molded innersole which can provide cushioning and/or support and which takes up less space in the shoe than other known innersole and which will allow the foot to move normally within the shoe. It would also be desirable to provide an innersole which is durable, i.e. retains its original shape, resiliency, and remain as one piece. It would also be desirable to provide a lightweight, flexible innersole that can fit most footwear styles, with little or no trimming needed.

SUMMARY OF THE INVENTION

In its first and broadest embodiment, the present invention is a removable, three quarter length, innersole for an article of footwear, adapted to provide cushioning and/or support to a foot, comprising:

a forward toe portion having a radius edge, a rear heel portion having a radius edge and an intermediate arch cushion portion between said toe and heel portions, wherein said forward toe portion, said rear heel portion and said intermediate arch cushion portion are one-piece; said innersole being resilient and being defined by:

a1) a first flat bottom surface, a2) a second upper surface generally convex-shaped to define the contour of the intermediate arch portion of said innersole, and a3) a third concave-shaped surface extending from said bottom surface to said upper surface to define with said upper surface a projection extending upwardly from said bottom surface and outwardly at a distance about equal to or greater than the tangent of said toe radius edge and said heel radius edge, said projection defining a space beneath said third surface;

said innersole permitting said projection to resiliently deform into the space defined by said projection upon application of a load to said innersole.

In a second embodiment, the resilient innersole of the first embodiment further comprises a topcover layer bonded to the upper surface of said resilient innersole.

In a third embodiment, the innersole of the first embodiment further comprises a bottom layer bonded to said first flat bottom surface of said resilient innersole. More preferably, the bottom layer is bonded to said first flat bottom surface and to said third surface.

In a fourth embodiment, the present invention is a removable, three quarter length innersole for an article of footwear, adapted to provide cushioning and/or support to a foot, comprising:

a forward toe portion, a rear heel portion and an intermediate arch portion between said toe and heel portions;

said innersole further comprising an upper topcover layer, a middle resilient layer and bottom layer, a) said middle resilient layer is one-piece and being defined by:

a1) a first flat bottom surface, a2) a second upper surface generally convex-shaped to define the contour of the intermediate arch portion of said innersole, and a3) a third concave-shaped surface extending from said bottom surface to said upper surface to define with said upper surface a projection extending upwardly from said bottom surface and outwardly at a distance about equal to or greater than the tangent of said toe radius edge and said heel radius edge, said projection defining a space beneath said third surface;

b) said bottom layer and said topcover layer being bonded to the upper and bottom surface, respectively, of said middle resilient layer;

said innersole permitting said projection to resiliently deform into the space defined by said projection upon application of a load to said innersole.

The present innersole is designed to fit the general shape of the foot's plantar surface, medially, along the longitudinal arch, while cushioning the heel and metatarsals. Cushioning and/or support is provided to the arch area by the specially designed arch portion in conjunction with the resiliency of the materials employed.

In the fourth and most preferred embodiment, the present innersole contains three layers which are integrally molded into a single article. In the fourth embodiment, the middle resilient layer generally is the same article as the innersole of the first embodiment. Preferably, the middle resilient layer is a polyurethane foam and the topcover layer is a polyurethane foam sheet. Also preferred is that the bottom layer functions by resisting slippage within the footwear, i.e. is a non-slip surface or coating. Also preferred is that the toe portion is beveled or tapered and the heel portion is generally flat.

One advantage of the present invention is that it can provide a lightweight, breathable innersole that can help to reduce over-pronation, a physical affliction connected to many common foot, ankle, lower-leg and knee problems.

A second advantage is that the present innersole can relieve the discomfort associated with over-supinated feet, since the innersole can relieve some of the load on the high arch and also cushion the high pressure areas of the heel and metatarsals.

A third advantage is that the present innersole can be readily used to support and cushion normal feet in footwear that have little or no arch support.

A fourth advantage is that the present innersole can be designed to fit most footwear styles for men, women and children.

A fifth advantage of the present innersole is that since it is slimmer and less bulkier than other known innersoles having arch supports. The present innersole can be comfortably worn by the user with the user's normal size footwear, without the need to resort to larger footwear sizes.

A sixth advantage is that the present innersole can be designed so that trimming of the innersole to fit the user's footwear is unnecessary.

BRIEF DESCRIPTION OF THE DRAWINGS

In the following figures, the terms "view" and "perspective" are used interchangeably.

DETAILED DESCRIPTION OF THE EMBODIMENTS

Figure 1:
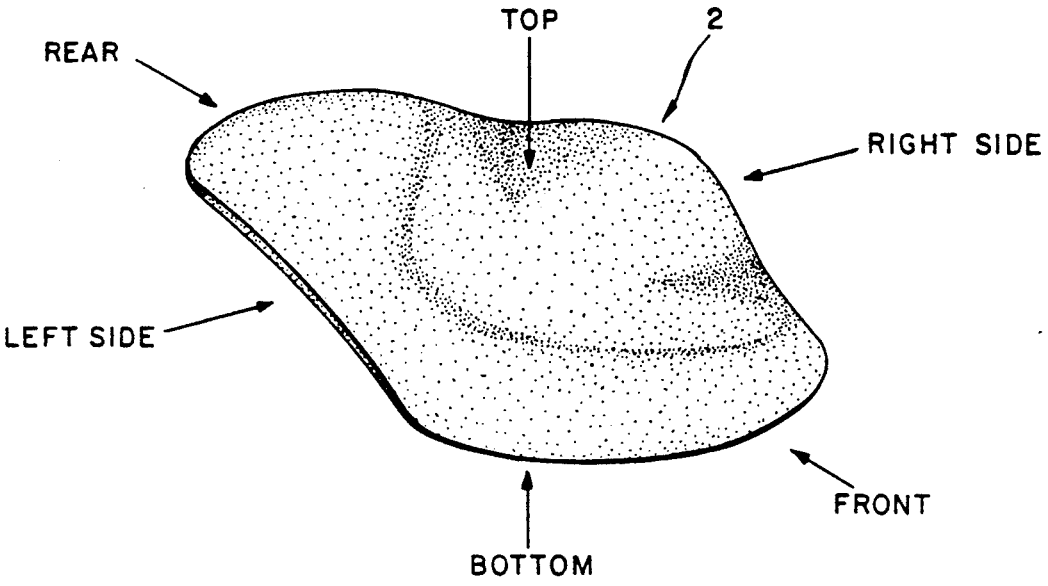
FIG. 1 depicts the directional terminology associated with the use of a right innersole from a top front perspective.

General dimensional requirements for the present innersole are indicated by, but not limited to the following:

| INNERSOLE DIMENSIONS | SMALL | MEDIUM | LARGE |
|---|---|---|---|
| Arch Height | | | |
| inches | 0.731 | 0.813 | 0.894 |
| centimeters | 1.857 | 2.064 | 2.270 |
| Heel Thickness | | | |
| inches | 0.150 | 0.150 | 0.150 |
| centimeters | 0.381 | 0.381 | 0.381 |
| Toe Thickness | | | |
| inches | 0.045 | 0.045 | 0.045 |
| centimeters | .0114 | 0.114 | 0.114 |
| Insert Length | | | |
| inches | 7.313 | 8.125 | 8.938 |
| centimeters | 18.574 | 20.638 | 22.703 |
| Arch Peak, Distance from heel | | | |
| inches | 3.857 | 4.300 | 4.730 |
| centimeters | 9.797 | 10.922 | 12.014 |

In the following discussions, the preparative teachings of any patents disclosed herein are incorporated herein by reference.

In the present innersole, three quarter length refers to the heel-to-ball length.

The topcover employed in the present innersole can be prepared from, but not limited to, materials, such as leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral topcovers. Desirable characteristics of the topcover include good durability, stability and visual appearance. Also desired is that the topcover material have good flexibility, as indicated by a low modulus, in order to be easily moldable. The bonding surface of the topcover must provide an appropriate texture in order to achieve a suitable mechanical bond to the middle resilient layer. A preferred topcover material is a mechanically frothed polyurethane sheet, which can be made on an embossed release liner. The topcover material is typically coated on both sides with a clear, ultraviolet (UV) cured, cross-linked acrylic coating to prevent blocking, i.e. sticking to itself in rolled form.

The middle resilient layer of the present innersole (i.e. same as the resilient innersole of the first embodiment) can be prepared from any suitable foam, such as cross-linked polyethylene, ethylenevinyl acetate, or polyvinyl chloride, silicone foams and gels, latex foams, aliphatic urethanes, most preferably polyurethane foams such as the elastomeric polyurethanes. Such foams can be blown with freon, water, methylene chloride or other gas producing agents, as well as by mechanically frothing to prepare the resilient core. Such foams advantageously can be molded into the desired resilient core. For example, U.S. Pat. Nos. 3,489,594, 4,722,946 and 4,476,258 describe suitable energy absorbing polyurethane compositions. A preferred resilient polyurethane can be prepared from diisocyanate prepolymer, polyol, catalyst and stabilizers which provide a polyether polyurethane foam of the desired physical attributes. Suitable diisocyanate prepolymer and polyol components include diphenylmethane diisocyanate prepolymer XAS 10971.02 and polyether polyol/fluorocarbon blend XUS 18016.00, both available from the Dow Chemical Company, Midland, Mich.; Polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; and Niax 34-28, available from Union Carbide, Danbury, Conn. Suitable catalysts include Dabco 33-LV(CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa. or Fomrez UL-38, a stannous octoid, from the Witco Chemical Co., New York, N.Y. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. An important feature of the middle resilient layer is that it is made of one-piece. "One piece" means that the middle resilient layer is of unitary construction, rather than of laminate construction. Further, the middle resilient layer is the portion of the innersole which provides cushioning and/or support to a foot.

The bottom of the present innersole can be prepared from any suitable material, including those described before for the topcover and middle resilient layer. Adhesives, materials having a high coefficient of friction, or the bottom layer, can provide non-slip features or semi-permanent attachment of the device in the shoe. These methods can be used over part of the innersole, such as the flat bottom surface, or over all of the innersole flat bottom surface and the third concave-shaped surface of the arch cushion. Preferably the bottom is a non-slip, acrylic coating described in "Method for Preparing Molded Innersoles Having a Non-Slip Surface," supra, whose preparative teachings are incorporated herein by reference. The non-slip coating can be preapplied to a bottom mold cavity prior to adding a polyurethane mixture. The coating molds integrally to the resultant polyurethane foam layer.

The table below summarizes characteristics of a range of materials which can be employed in the innersole of the present invention. One of ordinary skill in the art will appreciate that the characteristics of the innersole can vary from portion to portion and within each layer. For example, within the heel portion, toe portion and intermediate arch portion the thickness, hardness, density, etc. of each layer can vary within the layer.

| | TOPCOVER LAYER | RESILIENT LAYER | BOTTOM LAYER | INNERSOLE |
|---|---|---|---|---|
| THICKNESS | | | | |
| inches | 0–0.25 | 0.005–0.75 | 0–0.25 | 0.005–1.0 |
| centimeter | 0–0.635 | 0.013–1.905 | 0–0.635 | 0.013–2.54 |
| HARDNESS | | | | |
| Shore 00 durometer | 20 to 100 units | 20 to 100 units | 20 to 100 units | 20 to 100 units |
| DENSITY[1] | | | | |
| lb/cu. ft. | 2–35 | 2–35 | 2–35 | 2–35 |
| g/cc | 0.032–0.561 | 0.032–0.561 | 0.032–0.561 | 0.032–0.561 |
| COMPRESSION SET | | | | |
| % of original thickness | 0–20 | 0–20 | 0–20 | 0–20 |
| COMPRESSION LOAD DEFLECTION | At 25% compression | At 25% compression | At 25% compression | At 25% compression |
| lb/sq. in. | 10–50 | 10–50 | 10–50 | 10–50 |
| kg/sq. cm | 70.3–351.5 | 70.3–351.5 | 70.3–351.5 | 70.3–351.5 |

[1]Density of innersole can vary from portion to portion and within each layer.

The innersole of the present invention can be prepared by conventional methods such as heat sealing, ultrasonic sealing, radiofrequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530,489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. Preferably, the innersole is prepared by a foam reaction molding process such as taught in U.S. Pat. No. 4,694,589.

DETAILED DESCRIPTION OF THE DRAWINGS

FIG. 1 shows that right innersole 2 has a front view, a bottom view, a right side view, a left side view, a rear view, a top view and a bottom view.

Figure 1A:
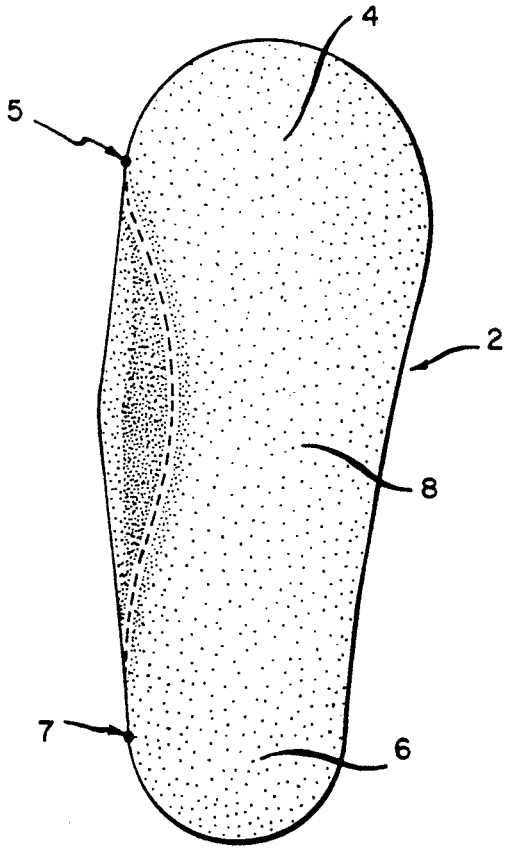
FIG. 1A represents an illustration of the top view of the innersole.

In FIG. 1A, innersole 2 is comprised of a forward toe portion 4, intermediate arch cushion portion 8 and rear heel portion 6. Forward toe portion 4 works to support the metatarsals. Rear heel portion 6 works to support the calcaneus. Intermediate arch portion 8 is centered on the cuneiform bone to allow for natural fitting of the cushion to the foot, and works to support the, talus and navicular bones, as well as their associated joints. Forward toe portion 4 has a radius edge 5 and rear heel portion 6 has a radius edge 7.

Figure 1B:
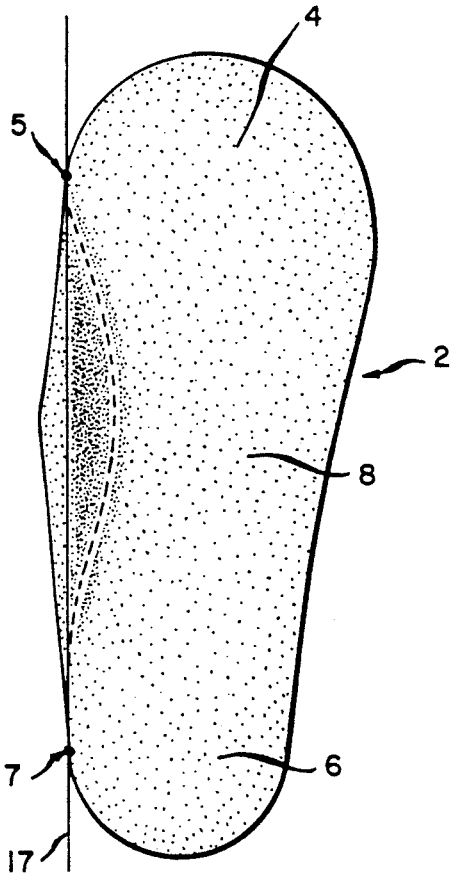
FIG. 1B represents the top view of FIG. 1 with a tangent drawn to the radius edges of the innersole.

In FIG. 1B, tangent 17 connects radius edges 5 and 7.

Figure 2:
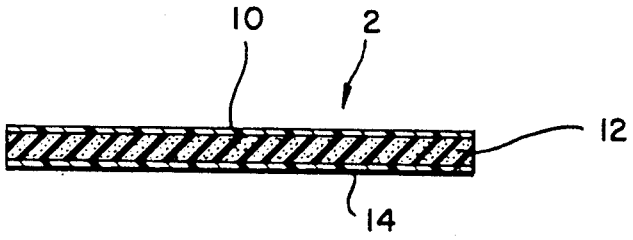
FIG. 2 represents a cross-sectional view of a three layer innersole, molded integrally.

In FIG. 2 is shown a cross section for a relatively flat forward toe or rear heel portion of innersole 2, comprised of an upper topcover layer 10, a one-piece middle resilient layer 12 and a bottom layer 14, molded integrally.

Figure 3:
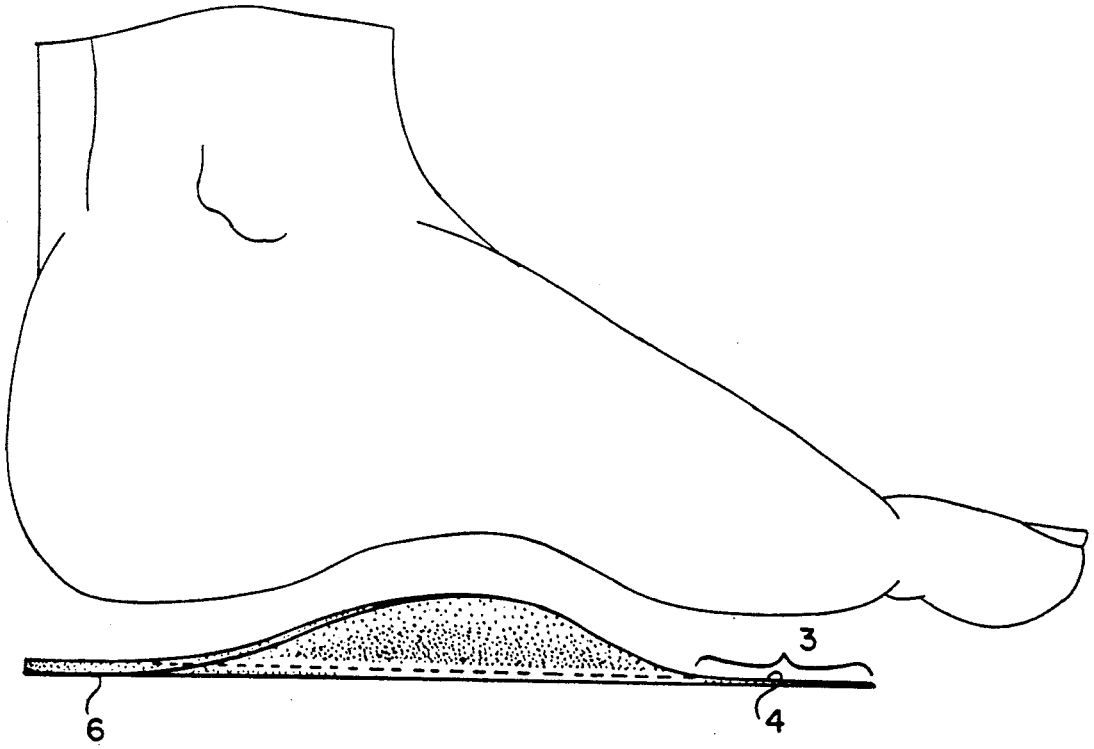
FIG. 3 represents the placement of a foot relative to a side view of the innersole.

FIG. 3 shows a foot being placed on innersole 2 having a taper 3 of the three layers toward forward toe portion 4. Taper 3 and forward toe portion 4 approximately underlie the ball of the foot and serve to cushion the metatarsals as they taper off to a thin edge. The three-quarter length and tapered toe portion 4 allow for maximum toe room in the shoe. Sufficient stability to the heel can be provided by the shoe itself and sufficient layer thicknesses can be provided to the rear heel portion 6 to cushion the heel of the foot. Optionally, though less preferably, rear heel portion 6 can be contoured to form a heel cup.

Figure 4B:
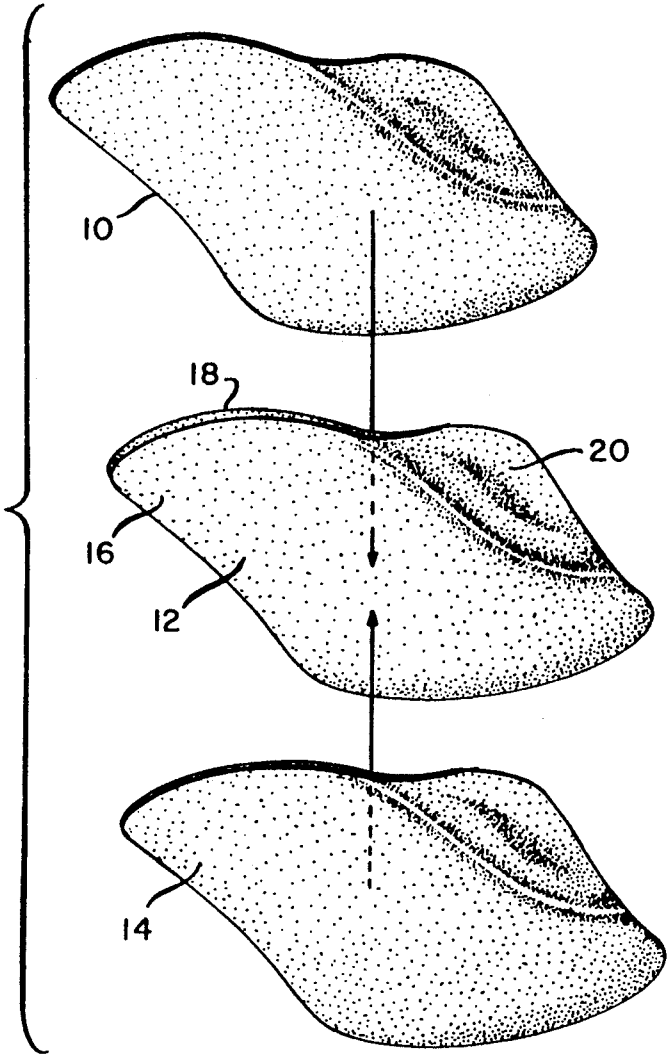
FIG. 4B represents an exploded bottom view of a left innersole from the rear view.
Figure 4A:
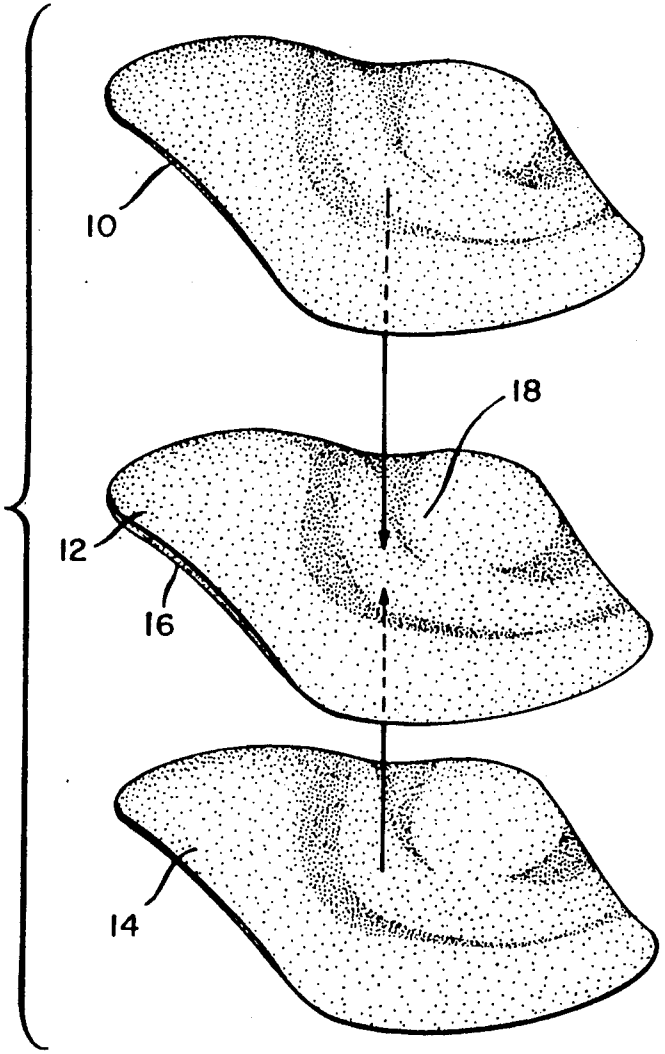
FIG. 4A represents an exploded top view of a right innersole from the front view.

FIG. 4A shows a front end perspective of a three layer right innersole in which upper topcover layer 10 is bonded to the second upper surface 18 of one-piece middle resilient layer 12, and bottom layer 14 is bonded to bottom surface 16 (not visible) of middle resilient layer 18.

FIG. 4B shows a rear bottom perspective of a three layer left innersole in which upper topcover layer 10 is bonded to the second upper surface 18 (not shown) of one-piece middle resilient layer 12, and bottom layer 14 is bonded to lower surfaces 16 and 20 of middle resilient layer 12.

Figure 5A:
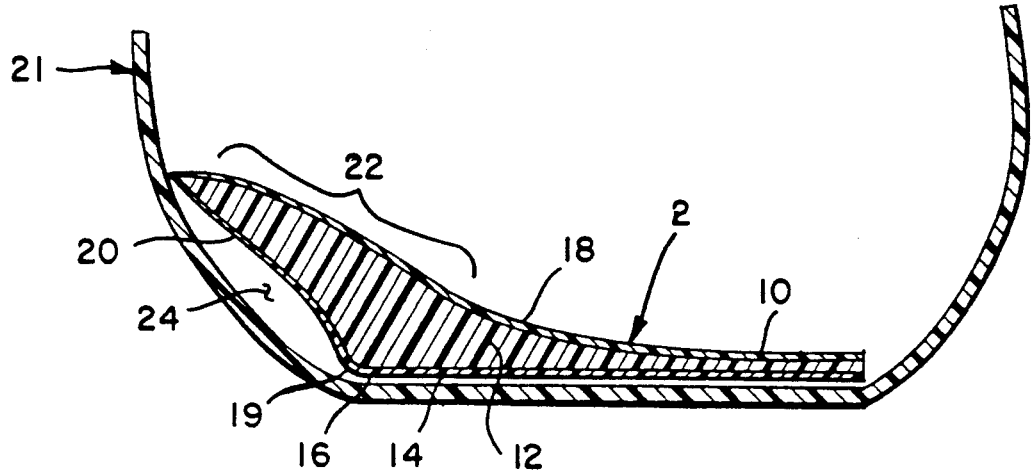
FIG. 5A represents a cross-section view taken through the intermediate arch portion of the innersole in a shoe absent a load, i.e. a foot.

FIG. 5A shows a cross-section of shoe 21 without a load containing three-layered innersole 2, with one-piece middle resilient layer 12 bonded to topcover 10 and bottom layer 14. Concave-shaped third surface 20 extends from bottom surface 16 to upper surface 18. Upper surface 18 includes the convex-shaped surface of projection 22. Projection 22 extends upwardly from bottom surface 16 and outwardly. Projection 22 also defines a space 24 beneath concave-shaped third surface 20. Space 24 allows innersole 2 to adjust to the foot during use, by compressing any extra cushioning into this space. Where a foam is used for one-piece resilient layer 12, support is achieved from the compression resistance of the foam as well as by ridge 19 formed at the junction of third surface 20 and bottom surface 16, thus providing lengthwise rigidity during bending and flexing, while walking. Ridge 19 can also serve as an anchorpoint for projection 22, thus restraining that portion from stretching away from bottom surface 16 and preventing excessive flattening of projection 22. Topcover 10 can also interact with the foam around the anchored area to limit stretching of projection 22 during walking. The combined operation of the compression resistance of the foam together with the spring-like action of projection 22 helps to support the arch area.

Figure 5B:
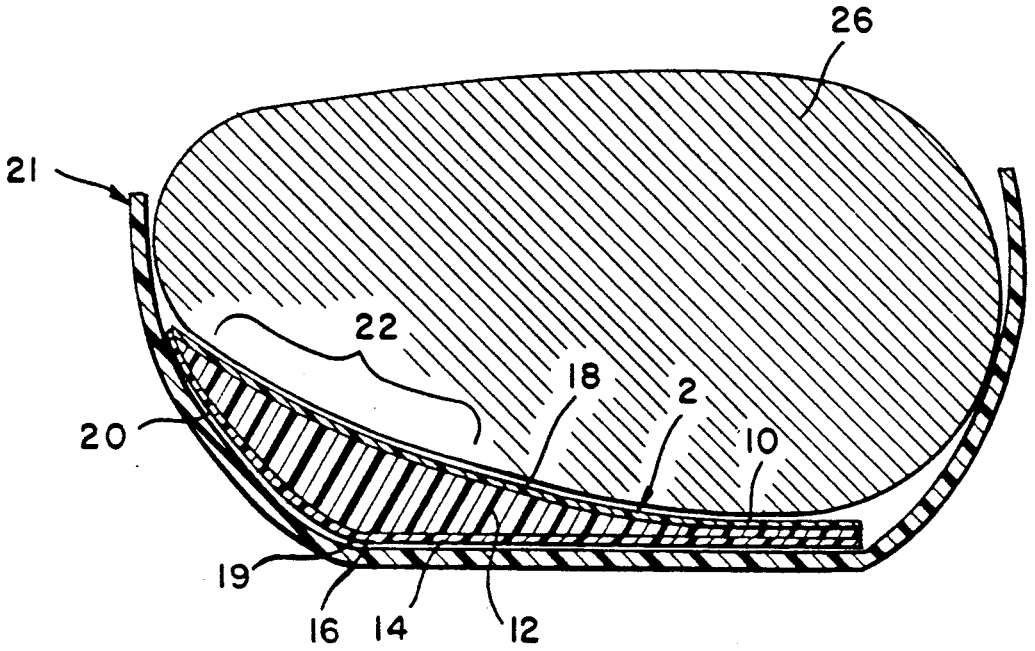
FIG. 5B represents a cross-section view taken through the intermediate arch portion of an innersole in a shoe with a partial load, i.e. a foot, showing structural deformation of the arch cushion.

In FIG. 5B, application of load 26 to innersole 2 causes projection 22 to resiliently deform into space 24 in FIG. 5A. Alternatively, projection 22 could deform partially into space 24.

The following example illustrates the present invention and the manner by which it can be practiced, but as such, should not be construed as limitations upon the overall scope of the same.

EXAMPLE

A pre-warmed two-part mold is used having a top cavity and a bottom cavity. A topcover of mechanically frothed, polyurethane foam is attached to the top cavity. The bottom cavity, having a permanent release coating, is spray coated with a non-slip acrylic coating. After the coating has dried, polyurethane is poured into the bottom cavity and the mold is closed. The foam expands and the part is cured. The part is demolded and die-cut, yielding a molded innersole having three layers that are integrally bound into one article.

What is claimed is:

1. A removable, three quarter length innersole for an article of footwear, adapted to provide cushioning and/or support to a foot, comprising:

a forward toe portion having a radius edge, a rear heel portion having a radius edge and an intermediate arch cushion portion between said toe and heel portions, wherein said forward toe portion, said rear heel portion and said intermediate arch cushion portion are one-piece;

said innersole being resilient and being defined by:

a1) a first flat bottom surface, a2) a second upper surface generally convex-shaped to define the contour of the intermediate arch portion of said innersole, and a3) a third concave-shaped surface extending from said bottom surface to said upper surface to define with said upper surface a projection extending upwardly from said bottom surface and outwardly at a distance about equal to or greater than the tangent of said toe radius edge and said heel radius edge, said projection defining a space beneath said third surface;

said innersole permitting said projection to resiliently deform into the space defined by said projection upon application of a load to said innersole.

2. The innersole of claim 1 further comprising a topcover layer bonded to the upper surface of said resilient innersole.

3. The innersole of claim 2 further comprising a bottom layer bonded to said first flat bottom surface of said resilient layer.

4. The innersole of claim 3 wherein the bottom layer is a non-slip coating.

5. The innersole of claim 1 further comprising a bottom layer bonded to said first flat bottom surface of said resilient innersole.

6. The innersole of claim 5 wherein the bottom layer is bonded to said first flat bottom surface and to said third surface.

7. A removable, three quarter length innersole for an article of footwear, adapted to provide cushioning and/or support to a foot, comprising:

a forward toe portion, a rear heel portion and an intermediate arch portion between said toe and heel portions;

said innersole further comprising an upper topcover layer, a middle resilient layer and bottom layer, a) said middle resilient layer is one-piece and being defined by:

a1) a first flat bottom surface, a2) a second upper surface generally convex-shaped to define the contour of the intermediate arch portion of said innersole, and a3) a third concave-shaped surface extending from said bottom surface to said upper surface to define with said upper surface a projection extending upwardly from said bottom surface and outwardly at a distance about equal to or greater than the tangent of said toe radius edge and said heel radius edge, said projection defining a space beneath said third surface;

b) said bottom layer and said topcover layer being bonded to the upper and bottom surface, respectively, of said middle resilient layer;

said innersole permitting said projection to resiliently deform into the space defined by said projection upon application of a load to said innersole.

8. The innersole of claim 7 further comprising a topcover layer, a middle resilient layer and a bottom layer, the three of which are integrally molded into a single article.

9. The innersole of claim 7 wherein the middle resilient layer is a polyurethane foam and the topcover layer is a polyurethane foam sheet.

10. The innersole of claim 9 wherein the bottom layer is non-slip coating.

11. The innersole of claim 9 wherein the toe portion is tapered.

12. The innersole of claim 10 wherein the heel portion is generally thicker than the toe portion.

* * * * *